US008061256B1

(12) United States Patent
Kurz et al.

(10) Patent No.: US 8,061,256 B1
(45) Date of Patent: Nov. 22, 2011

(54) CARTRIDGE LOOP WITH COMPLIANT TAB FOR AMMUNITION BELT

(75) Inventors: Arthur Kurz, New Vernon, NJ (US); Bernard Duetsch, Summit, NJ (US); Yusef Tilipman, Livingston, NJ (US)

(73) Assignee: A.K. Stamping Company, Inc., Mountainside, NJ (US)

( * ) Notice: Subject to any disclaimer, the term of this patent is extended or adjusted under 35 U.S.C. 154(b) by 0 days.

(21) Appl. No.: 12/838,194

(22) Filed: Jul. 16, 2010

(51) Int. Cl.
*F42B 39/08* (2006.01)

(52) U.S. Cl. ..... 89/33.2; 89/35.01

(58) Field of Classification Search ..... 89/33.14, 89/33.16, 33.2, 33.25, 35.01, 35.02; 42/87, 42/88, 89; 24/2.5; 59/2, 11
See application file for complete search history.

(56) References Cited

U.S. PATENT DOCUMENTS

| | | | | |
|---|---|---|---|---|
| 2,480,950 | A * | 9/1949 | Murphy | 89/35.02 |
| 3,254,565 | A | 6/1966 | La Fever et al. | |
| 3,282,163 | A * | 11/1966 | Rocha | 89/33.2 |
| 3,563,132 | A * | 2/1971 | Cashen et al. | 89/33.14 |
| 4,011,788 | A * | 3/1977 | Reed | 89/33.2 |
| 4,401,008 | A * | 8/1983 | Walker, Jr. | 89/33.14 |
| 5,398,590 | A | 3/1995 | Snyder, Sr. | |
| 5,546,845 | A * | 8/1996 | Wossner et al. | 89/35.01 |
| 5,691,497 | A * | 11/1997 | Weichert et al. | 89/1.4 |
| 7,406,907 | B1 | 8/2008 | Goon et al. | |
| 7,406,908 | B1 | 8/2008 | Goon et al. | |
| 2008/0083322 | A1 * | 4/2008 | Becker | 89/33.14 |
| 2008/0245219 | A1 * | 10/2008 | Moucheboeuf et al. | 89/35.02 |

* cited by examiner

*Primary Examiner* — Bret Hayes
(74) *Attorney, Agent, or Firm* — McCarter & English, LLP

(57) ABSTRACT

A cartridge loop for an ammunition belt having a coupling interface with an opening and a pair of substantially parallel lines side walls having a compliant tab formed therein to deflect easily without deforming the loop when a coupling is engaged in the interface is provided. The compliant tab is formed by a U-shaped cut-out from the loop across the side walls to the front face of the coupling interface. The walls of the interface are separated by a distance and the coupling has first and second ends connected by a link connecting the first and second ends, the first end having a locking head with four sides having a diagonal that forms an interference fit with the compliant tabs formed in the side walls.

9 Claims, 6 Drawing Sheets

CARTRIDGE LOOP WITH COMPLIANT TAB FOR AMMUNITION BELT

BACKGROUND OF THE INVENTION

The invention relates generally to an apparatus for transporting ammunition cartridges through a gun firing system and, more particularly to an improved loop with a compliant tab for coupling adjacent cartridges of an ammunition belt.

Ammunition cartridges are conveyed through a weapon by a transport means to position and guide the cartridges through the gun firing system. The transport means generally includes couplings and loops. The cartridges are positioned in the loops and the couplings link the loops together. A plurality of cartridges and loops are connected together by the couplings to form an ammunition belt. The couplings and loops are physically shocked, pulled and distorted throughout the firing cycle and, therefore, require a certain strength to function properly.

Known ammunition belts are packaged for the specific end user in belt sizes with typically 32 or 94 rounds. Means for disconnecting or connecting (or assembling or disassembling) ammunition cartridges from the original belt by current and an improved easy-to-use connect/disconnect feature is shown in U.S. Pat. No. 7,406,907 to Goon and assigned to the United States of America. The contents of this patent is incorporated herein in its entirety.

As described in the Goon patent, loading of a new belt onto a weapon is time consuming and exposes the user to hostile fire during the belt re-loading stage. Perhaps the most important advantage of a connect/disconnect feature is the ability to connect additional belts to an already loaded belt of ammunition. It would be much easier and safer for a soldier under fire to simply connect additional belts to an already loaded belt, rather than having to reload each belt onto the weapon. Furthermore, in the past, partially used belts with only a few rounds have been discarded. With a connect/disconnect feature, the partially used belts can be connected together and used, thereby eliminating wasted ammunition and the problem of disposing of live, discarded ammunition.

Notwithstanding the recent improvements and advantages provided, there remains a need to provide yet a easier and safer way to connect/disconnect these ammunition belts.

SUMMARY OF THE INVENTION

Generally speaking, in accordance with the invention, a cylindrical cartridge loop having a coupling interface with an opening on a front wall connected to parallel side walls extending from the cylindrical loop with a U-shaped cut-out formed in the loop at the base of the side walls and extending to the front wall adjacent to the opening. The opening is defined in part by a pair of substantially parallel lines separated by a distance. The U-shaped cut-out forms a compliant tab along the side wall to facilitate engagement of a coupling engaged in the opening without permanent deformation of the loop.

The coupling interface on the loop is configured to engage a coupling having first and second ends and a link that connects the first and second ends. A portion of the first end of the link connecting with the coupling interface of the cartridge loop has a first thickness that is greater than the distance between the substantially parallel lines and a second thickness that is less than the distance between the substantially parallel lines. Alternative couplings have links with a cylindrical cross-section of two different diameters at each end to allow connection, but not disassembly.

The first end of the coupling has a locking head with four sides and the coupling interface has a front wall and two side walls disposed on opposite sides of the front wall, the opening of the coupling interface being defined in the front wall and the locking head being disposed between the side walls. Advantageously, a diagonal of the locking head has a length such that the diagonal forms an interference fit with the compliant tab formed in the side walls.

Accordingly, It is an object of the invention to provide an improved loop for forming an ammunition belt that is easily connected to and disconnected from other loops and ammunition belts.

Another object of the invention is to provide a loop and coupling type transport apparatus for ammunition cartridges wherein adjacent ammunition cartridges can be easily and quickly connected or disconnected.

A further object of the invention is to provide an ammunition cartridge transport apparatus that saves ammunition by allowing partially used belts of ammunition to be connected together.

Yet another object of the invention is to provide a loop for use with a coupling type ammunition cartridge transport apparatus wherein the coupling is rotatable from a locked position to an unlocked position.

Still another object of the invention is to provide an improved loop that can be used with existing couplings for connecting cartridge loops.

Yet a further object of the invention is to provide an improved loop that allows an interference fit with existing couplings and resists deformation of the loop.

The invention accordingly comprises a product possessing the features, properties, and the relation of components which will be exemplified in the product hereinafter described, and the scope of the invention will be indicated in the claims.

BRIEF DESCRIPTION OF THE DRAWINGS

For a fuller understanding of the invention, reference is had to the following description taken in connection with the accompanying drawing(s), in which.

DETAILED DESCRIPTION OF THE INVENTION

Figure 1:
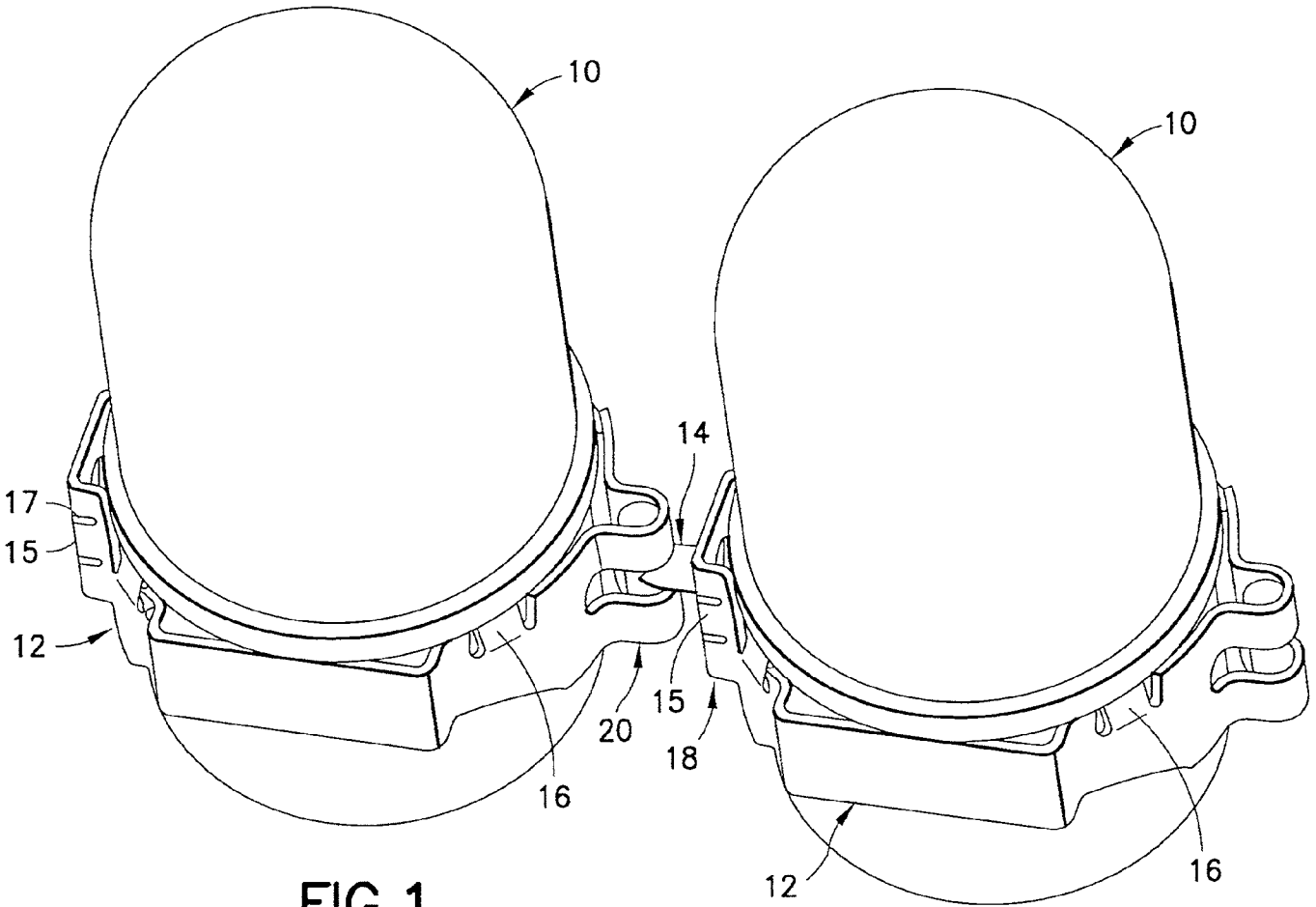
FIG. 1 is a perspective view of cartridges disposed in loops constructed and arranged in accordance with the invention.

FIG. 1 shows two cartridges 10 disposed in loops 12 having compliant tabs 15 constructed and arranged in accordance with the invention connected by a coupling 14. The detailed geometric shape of coupling 14 is disclosed in U.S. Pat. No. 7,406,907 and will be fully described later in connection with the discussion of FIGS. 5A-5C. An ammunition belt comprises a plurality of cartridges 10 disposed in loops 12 connected by couplings 14. A 32 round belt will have 32 cartridges disposed in 32 loops connected together with couplings.

Figure 2:
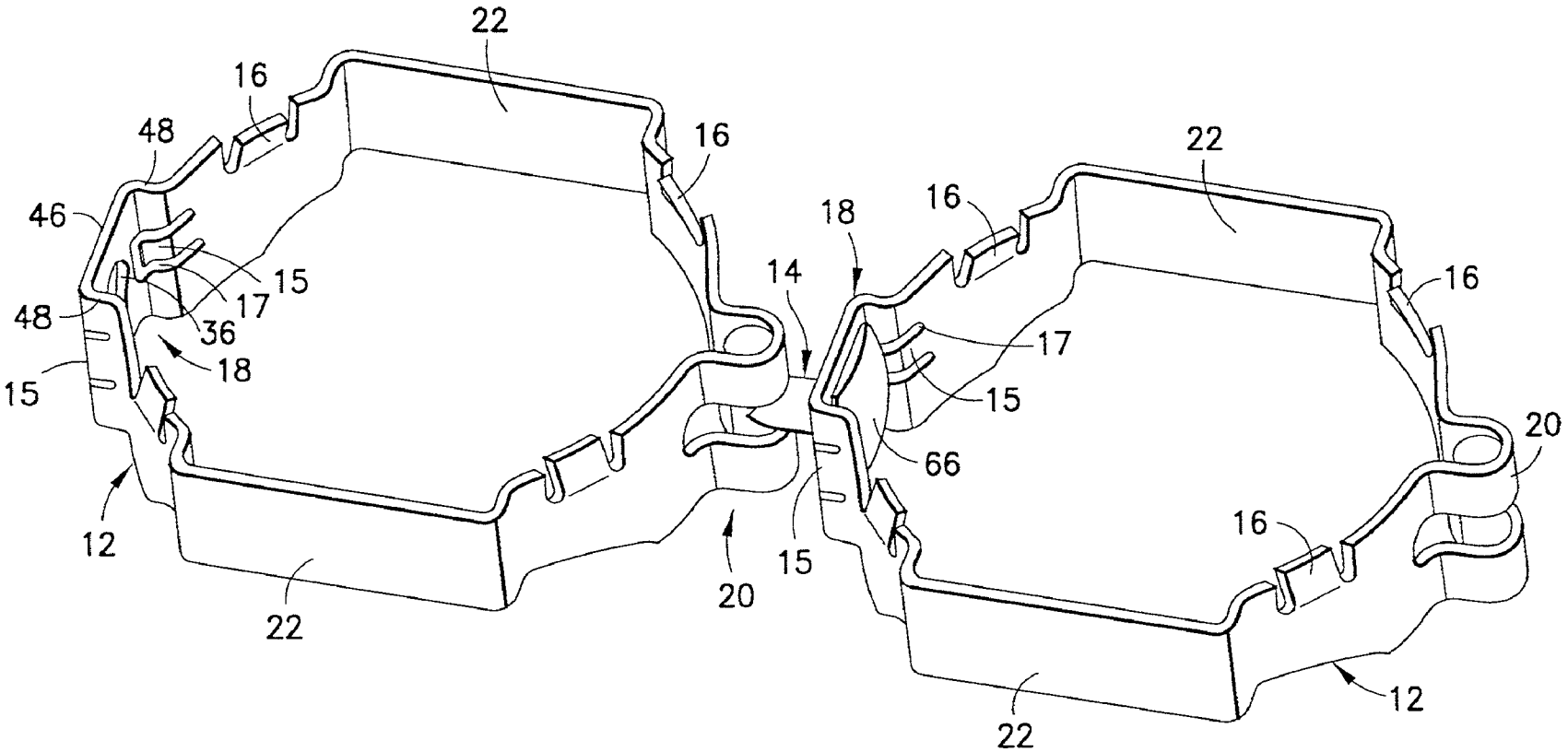
FIG. 2 shows the loops of FIG. 1 without the cartridges.

FIG. 2 shows two substantially cylindrical loops 12 coupled together by coupling 14 without cartridges 10. Locking tabs 16 on loops 12 help position cartridges 10 in loops 12. As shown in FIG. 2, loop 12 includes side members 22, a coupling support 20 on one end and a coupling interface 18 on another end. Coupling 14 connects coupling support 20 of one loop 12 to coupling interface 18 of another loop 12.

Figure 3:
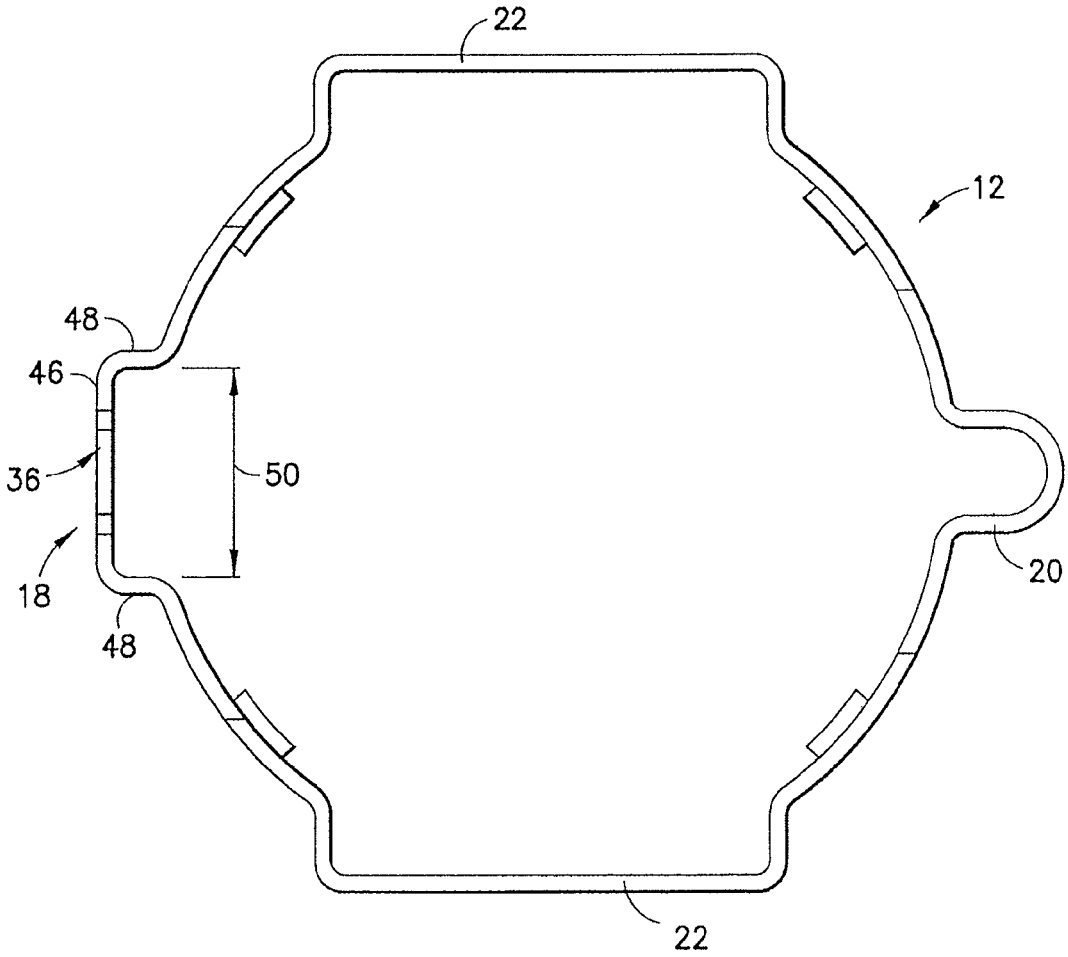
FIG.3 PRIOR ART
FIG. 3 is a bottom view of a cartridge loop.
Figure 4A:
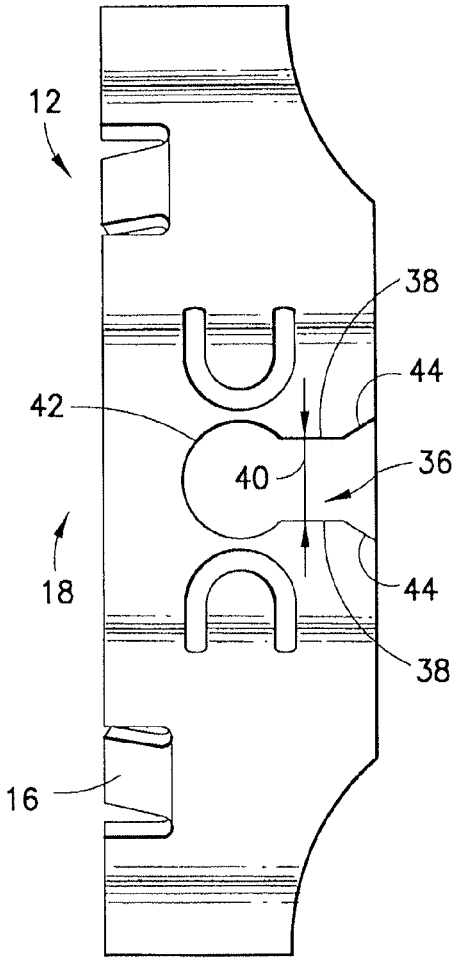
FIG. 4A is a side elevational view facing coupling interface of the loop of FIG. 1.

FIG. 3 is a bottom view of cartridge loop 12 and FIG. 4A is a side elevational view thereof. Cartridge loop 12 has coupling interface 18 formed with an opening 36 defined in part by a pair of substantially parallel lines 38 separated by a distance 40. Opening 36 is further defined by a curved portion 42 connected to one end of parallel lines 38 and a pair of diverging lines 44 connected to another end of parallel lines 38. Coupling interface 18 is defined by a front wall 46 and two side walls 48 disposed on opposite sides of front wall 46. Opening 36 of coupling interface 18 is defined in front wall 46. A distance 50 separates side walls 48.

Figure 4B:
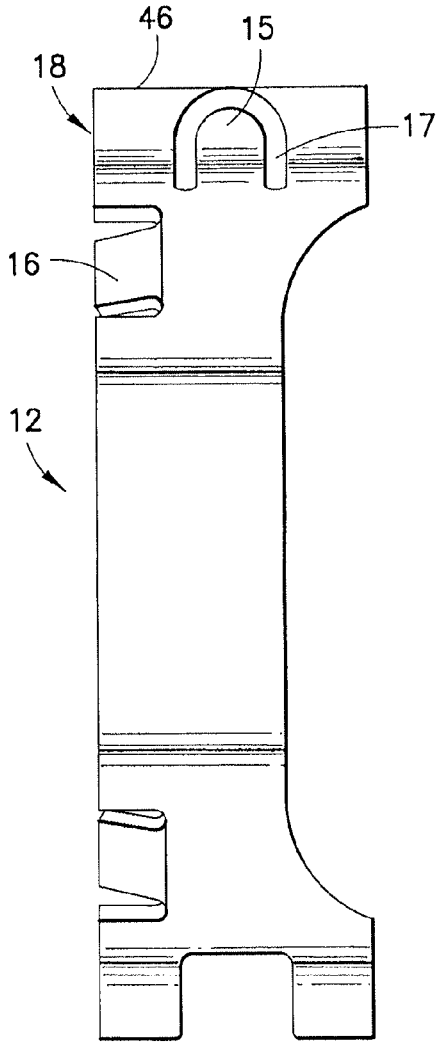
FIG. 4B is a side elevational view of the loop of FIG. 4A rotated 90'.

FIG. 4A is a side elevational view facing coupling interface 18 showing a compliant tab 15 extending across side wall 48 to front wall 46 of coupling interface 18 adjacent portion 42 of opening 38. Tab 15 is formed by cutting loop 12 in a "U-shape" at 17 with the curved end portion adjacent opening 38. FIG. 4B is another side elevational view of loop 12. However, in this view loop 12 is rotated 90° to face one of the side wall 48 to show compliant tab 15.

Figure 5C:
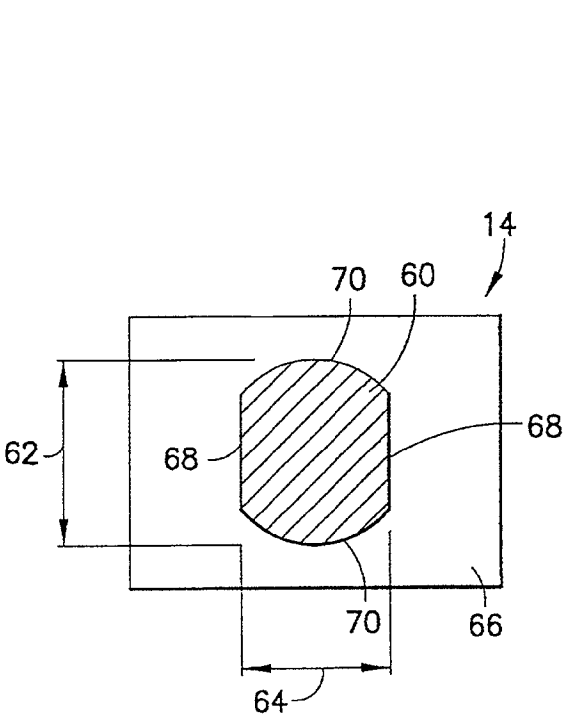
FIG.5C PRIOR ART
FIG. 5C is a detailed sectional view along the line 5C-5C of FIG. 5A.
Figure 5A:
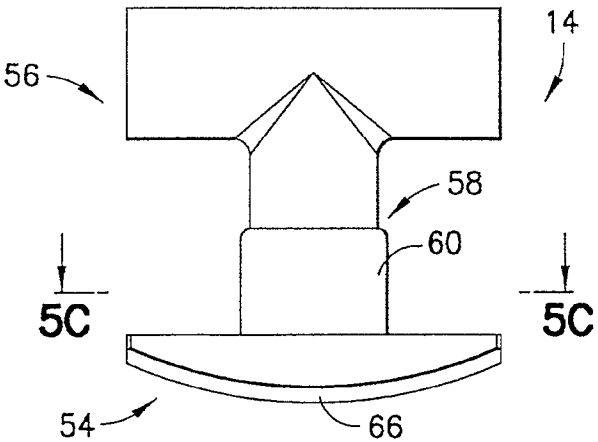
FIG.5A PRIOR ART
FIG. 5A is a detailed top view of one embodiment of a coupling suitable for use with a loop constructed in accordance with the invention.
Figure 5B:
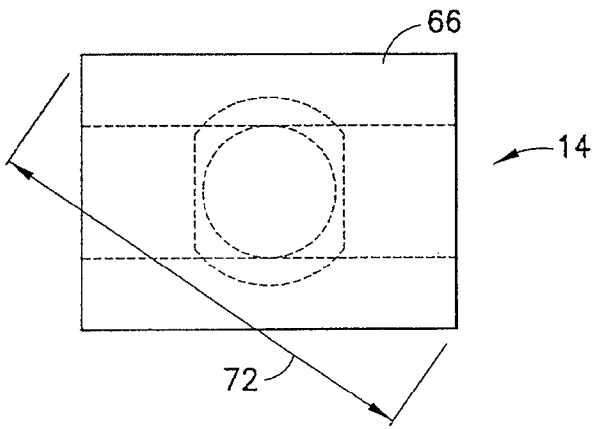
FIG.5B PRIOR ART
FIG. 5B is a detailed end view of the coupling of FIG. 5A.

FIG. 5A is a top view of one type of coupling 14 suitable for use with loop 12 in accordance with the invention. FIG. 5B is an end view of coupling 14 in FIG. 5A. FIG. 5C is a sectional view along a line 5C-5C. Coupling 14 has a first end 54 and a second end 56 and a link or neck 58 that connects first end 54 and second end 56. First end 54 is engaged by coupling interface 18 of cartridge loop 12. Second end 56 is engaged by coupling support 20 of an adjacent loop 12.

A portion 60 (FIG. 5C) of link 58 adjacent first end 54 has a thickness 62 that is greater than distance 40 between the substantially parallel lines 38 (FIG. 4B) and a thickness 64 that is less than distance 40 between the substantially parallel lines 38. Thickness 62 and thickness 64 are measured orthogonal to each other. A cross-section (FIG. 5C) of portion 60 of link 58 is formed with a pair of substantially parallel faces 68 separated by thickness 64. The cross-section of portion 60 of link 58 may also include a pair of arcs 70 connected to ends of the pair of substantially parallel lines 68, respectively. Thickness 62 corresponds to the longest distance between the pair of arcs 70.

First end 54 of coupling 14 includes a substantially rectangular shaped locking head 66 with four sides, as best seen in FIGS. 5B and 5C. Locking head 66 is positioned between side walls 48 (FIG. 4A) of coupling interface 18. Locking head 66 has a diagonal length 72 such that, when rotated, locking head 66 forms an interference fit with side walls 48 distance 50 apart. The interference fit allows a person, by applying a twisting torque to adjacent cartridges 10, to rotate locking head 66 within side walls 48 temporarily deform compliant tabs 15, but prevents locking head 66 from rotating freely within side walls 48 when no force is applied.

Figure 6C:
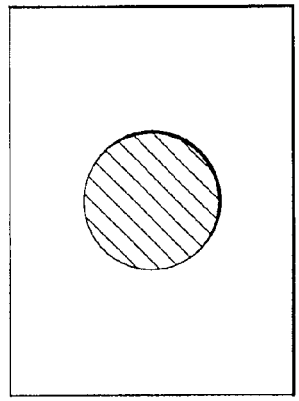
FIG.6C PRIOR ART
FIG. 6C is a sectional view along the 6C-6C of FIG. 6A.
Figure 6A:
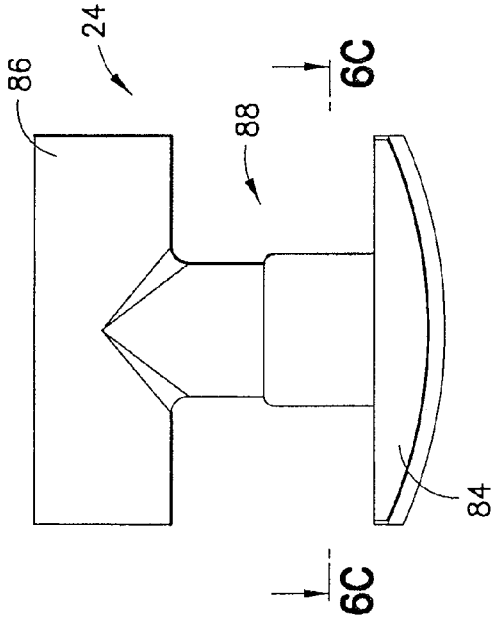
FIG.6A PRIOR ART
FIG. 6A is a top view of another coupling suitable for use with a loop constructed in accordance with the invention.
Figure 6B:
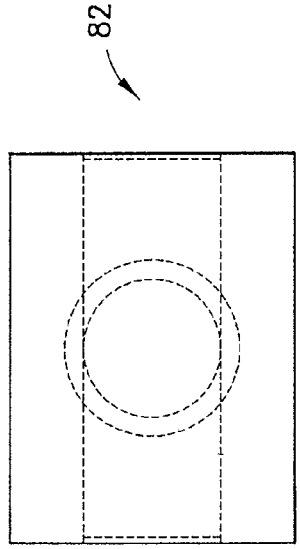
FIG.6B PRIOR ART
FIG. 6B is an end view of the coupling of FIG. 6A.

FIG. 6A is a top view of another coupling 82 suitable for use with loop 12. FIG. 6B is an end view of FIG. 6A. FIG. 6C is a sectional view along the line 6C-6C of FIG. 6A. Coupling 82 has a first end 84 and a second end 86 connected by a link 88. Once cartridge 10 is loaded into loop 12 and adjacent loops 12 are connected with coupling 82, it is difficult to disconnect coupling 82 from either coupling support 20 or coupling interface 18. This problem of connecting or disconnecting loaded loops 12 using known loops is alleviated as it is possible to deform compliant tabs 15 without impairing the structural integrity of loop 12.

During rotation of locking head 66, a snapping force is generated in loop 12. As locking head 66 is rotated within side walls 48, locking head 66 interferes with compliant tabs 15 on opposite side walls 48, causing tabs 15 to deform slightly outwards. As the ninety degree rotation continues and diagonal 72 of locking head 66 no longer contacts tabs 15 in side walls 48, tabs 14 formed in, tabs 15 snap back and help lock locking head 66 in position. This locking action maintains the characteristics of the known ammunition belt when exposed to the weapon firing forces. By providing compliant tabs 15 on side walls 48 the twisting force required to assemble adjacent cartridges is reduced substantially, yet locking head 66 remains firmly engaged between side walls 48.

The three beneficial features provided by coupling 14 of U.S. Pat. No. 7,406,907 for proper functioning are retained when using loop 12 formed with compliant tabs 15 in accordance with the invention. Thickness 62 of portion 60 (FIG. 5C) of link 58 adjacent first end 54 is greater than distance 40 between the substantially parallel lines 38 (FIG. 4B) of opening 36 of coupling interface 18. When coupling 14 is in a locked position, thickness 62 prevents coupling 14 from sliding out of opening 36.

Second, orthogonal thickness 64 of portion 60 (FIG. 5C) of link 58 adjacent first end 54 is less than distance 40 between the substantially parallel lines 38 of opening 36. When coupling 14 is in an unlocked position, narrower thickness 64 allows coupling 14 to slide out of the open end of opening 36 between diverging lines 72.

Third, diagonal length 72 of locking head 66 is such that the diagonal forms an interference fit between tabs 15 on opposite side walls 48 (spaced apart by distance 50) of coupling interface 18. Thus, coupling 14 may be rotated ninety degrees from a locked position to an unlocked position and vice versa as desired.

By providing at least one compliant tab 15 on coupling 14 at opening 36 in coupling interface 18 first end 54 may be engaged with reduced twisting force.

While the invention has been described with reference to certain preferred embodiments, numerous changes, alterations and modifications to the described embodiments are possible without departing from the spirit and scope of the invention as defined in the appended claims, and equivalents thereof.

It will thus be seen that the objects set forth above, among those made apparent from the preceding description, are efficiently attained and, since certain changes may be made in the above product without departing from the spirit and scope of the invention, it is intended that all matter contained in the above description and shown in the accompanying drawing(s) shall be interpreted as illustrative and not in a limiting sense.

The present invention may be embodied in other specific forms without departing from the spirit or essential attributes of the invention.

What is claimed is:

1. A cartridge loop, comprising:

a substantially rigid loop having a cylindrical loop coupling having a coupling interface with a front wall and two side walls on opposite sides of the front wall with an opening in the front wall defined in part by a pair of substantially parallel lines separated by a distance; and a compliant tab formed in the side walls and extending across the side walls to the front wall adjacent to the parallel lines.

2. The cartridge loop of claim 1, wherein the compliant tab has two opposed parallel sides connected by an arc adjacent to the parallel lines in the coupling interface.

3. The cartridge loop of claim 1, wherein the compliant tab is U-shaped with an arc adjacent to the parallel lines in the front wall of the coupling interface.

4. The cartridge loop of claim 1, wherein the compliant tab is formed by a cut out of two opposed parallel sides connected by an arc adjacent to the parallel lines in the coupling interface.

5. A cartridge loop and coupling assembly, comprising:

a substantially rigid cartridge loop having a coupling interface with a front wall and two side walls on opposite sides of the front wall with an opening in the front wall defined by a pair of substantially parallel lines separated by a distance;

a compliant tab formed in the side walls and extending from the front wall across the side walls; and a coupling having first and second ends and a link connecting the first and second ends, the first end connecting with the coupling interface of the cartridge loop;

wherein a portion of the link has a thickness less than the distance between the substantially parallel lines.

6. The assembly of claim 5, wherein a portion of the link adjacent the first end has a thickness that is greater than the distance between the substantially parallel lines and a second portion adjacent the second end that has a second thickness less than the distance between the substantially parallel lines.

7. The assembly of claim 5, wherein a portion of the link adjacent the first end has a first thickness that is greater than the distance between the substantially parallel lines and a portion having a second thickness less than the distance between the substantially parallel lines.

8. The assembly of claim 5, wherein the first end of the coupling comprises a locking head with four sides and the coupling interface comprises a front wall and two side walls disposed on opposite sides of the front wall, the opening of the coupling interface being defined in the front wall and the locking head being disposed between the side walls.

9. The assembly of claim 8, wherein a diagonal of the locking head has a length such that the diagonal forms an interference fit with the compliant tabs on the side walls.

* * * * *